US007656379B2

(12) United States Patent
Kim

(10) Patent No.: US 7,656,379 B2
(45) Date of Patent: Feb. 2, 2010

(54) DRIVING CIRCUIT FOR USE IN CHOLESTERIC LIQUID CRYSTAL DISPLAY DEVICE

(75) Inventor: Mun-Chul Kim, Annyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 11/984,688

(22) Filed: Nov. 20, 2007

(65) Prior Publication Data

US 2008/0088558 A1 Apr. 17, 2008

Related U.S. Application Data

(62) Division of application No. 10/747,525, filed on Dec. 30, 2003, now Pat. No. 7,319,451.

(30) Foreign Application Priority Data

Dec. 31, 2002 (KR) ..... 10-2002-0088484

(51) Int. Cl.
*G09G 3/36* (2006.01)

(52) U.S. Cl. ..... 345/99; 345/88

(58) Field of Classification Search ..... 345/87–89, 345/94, 95, 98, 99, 294, 690, 694
See application file for complete search history.

(56) References Cited

U.S. PATENT DOCUMENTS

| | | | | |
|---|---|---|---|---|
| 4,682,228 | A | 7/1987 | Ando et al. | |
| 4,957,349 | A | 9/1990 | Clerc et al. | |
| 4,994,901 | A | 2/1991 | Parulski et al. | |
| 5,499,036 | A * | 3/1996 | Hauck | 345/3.1 |
| 5,594,563 | A | 1/1997 | Larson | |
| 6,133,895 | A | 10/2000 | Huang | |
| 6,304,241 | B1 * | 10/2001 | Udo et al. | 345/96 |
| 6,344,889 | B1 * | 2/2002 | Hasegawa et al. | 349/129 |
| 6,369,858 | B1 | 4/2002 | Lee | |
| 6,847,483 | B2 | 1/2005 | Lippey et al. | |
| 6,850,295 | B1 | 2/2005 | Miyatake et al. | |
| 6,985,201 | B2 | 1/2006 | Iwasa et al. | |
| 7,084,844 | B2 * | 8/2006 | Yeo et al. | 345/88 |
| 7,180,567 | B2 | 2/2007 | Ikeda et al. | |
| 2003/0090603 | A1 | 5/2003 | Chae et al. | |
| 2006/0208982 | A1 | 9/2006 | Hashimoto | |

FOREIGN PATENT DOCUMENTS

| | | |
|---|---|---|
| JP | 08-016134 | 1/1996 |
| JP | 2002-365608 | 12/2002 |
| KR | 2000-5397 | 1/2002 |

* cited by examiner

*Primary Examiner*—Ricardo L Osorio
(74) *Attorney, Agent, or Firm*—McKenna Long & Aldridge

(57) ABSTRACT

A liquid crystal display device of the present invention comprises: a liquid crystal display panel; a cholesteric liquid crystal layer in the liquid crystal panel; a data controller having a connection with the liquid crystal display panel, wherein the data controller receives red, green and blue data signals from an external source and provides the signals to the liquid crystal panel; and a data amplifying circuit in the data controller, the data amplifying circuit selecting one of the red, green and blue data signals and then overdriving the selected data signal.

6 Claims, 8 Drawing Sheets

DRIVING CIRCUIT FOR USE IN CHOLESTERIC LIQUID CRYSTAL DISPLAY DEVICE

This is a divisional application of application Ser. No. 10/747,525 filed Dec. 30, 2003 now U.S. Pat. No. 7,319,451, which claims the benefit of Korean Application No. 2002-0088484 filed Dec. 31, 2002, which is hereby incorporated by reference for all purposes as if fully set forth herein.

BACKGROUND OF THE INVENTION

1. Field of the Invention

The present invention relates to a liquid crystal display device, and more particularly to a reflective liquid crystal display device using a cholesteric liquid crystal color filter layer.

2. Discussion of the Related Art

Liquid crystal display (LCD) devices with light, thin, and low power consumption characteristics are used in office automation equipment, video units and the like. Such LCDs typically use a liquid crystal (LC) interposed between upper and lower substrates with an optical anisotropy. Because the LC has thin and long LC molecules, the alignment direction of the LC molecules can be controlled by applying an electric field to the LC molecules. When the alignment direction of the LC molecules is properly adjusted, the LC is aligned and light is refracted along the alignment direction of the LC molecules to display images.

In general, LCD devices are divided into transmissive LCD devices and reflective LCD devices based upon whether the display device uses an internal or external light source.

A related art LCD device includes an array substrate, a color filter substrate, and a liquid crystal interposed between the array and color filter substrates. In general, voltages are applied to two electrodes which are formed on the array and color filter substrates, respectively, whereby an electric field generated between the two electrodes moves and arranges molecules of the liquid crystal. In order to display images in the LCD device, light should pass through the liquid crystal. Therefore, a backlight device is required to generate the light to pass through the liquid crystal.

A related art LCD device has an LCD panel and a backlight device. The incident light from the backlight is attenuated during the transmission so that the actual transmittance is only about 7%. A transmissive LCD device requires a high, initial brightness light source, and thus electrical power consumption by the backlight device increases. A relatively heavy battery is needed to supply sufficient power to the backlight of such a device, and the battery can not be used for a lengthy period of time.

In order to overcome the problems described above, a reflective LCD has been developed. Because the reflective LCD device uses ambient light instead of the backlight by using a reflective opaque material as a pixel electrode, the reflective LCD may be light and easy to carry. In addition, the power consumption of the reflective LCD device may be reduced so that the reflective LCD device can be used as an electric diary or a PDA (personal digital assistant).

However, the reflective LCD device is affected by its surroundings. For example, the brightness of ambient light in an office differs largely from that of the outdoors. Therefore, the reflective LCD device can not be used where the ambient light is weak or does not exist. Furthermore, the reflective LCD device has a problem of poor brightness because the ambient light passes through the color filter substrate and is reflected toward the color filter substrate by a reflector on the array substrate. Namely, because the ambient light passes through the color filter substrate twice, the reflective LCD device has a low light transmissivity and thus, poor brightness.

In order to overcome the above-mentioned problem, it is necessary to improve the transmittance of the color filter. To improve the transmittance, the color filter needs to have low color purity. However, a limitation is encountered by lowering the color purity because it is difficult to form a color filter thickness under a critical margin using a color resin. Accordingly, an LCD device having a layer for selectively reflecting and transmitting light is being researched and developed.

In general, liquid crystal molecules have a specific liquid crystal phase based on their structure and composition. The liquid crystal phase is affected by temperature and concentration. The most common liquid crystal is nematic liquid crystal in which the molecules of liquid crystal are oriented in parallel lines in one direction. The nematic liquid crystal has been extensively researched and developed and applied to various kinds of liquid crystal display devices.

Recently to improve the operating characteristics (such as brightness) of the reflective LCD device, a cholesteric liquid crystal (CLC), which selectively transmits or reflects light with a specific color, has been studied and developed. The CLC usually has liquid crystal molecules whose axes are twisted or includes chiral stationary phase molecules and nematic liquid crystal molecules that are twisted by the chiral stationary phase molecules. In general, the nematic liquid crystal has a regular arrangement in parallel to one another, while the cholesteric liquid crystal has a plural-layered structure. The regular arrangement of nematic liquid crystal appears in each layer of the cholesteric liquid crystal.

Furthermore, the CLC has a helical shape and the pitch of the CLC is controllable. Therefore, the CLC color filter can selectively transmit or/and reflect the light. In other words, as is well known, all objects have an intrinsic wavelength, and the color that an observer recognizes is the wavelength of the light reflected from or transmitted through the object. The wavelength ($\lambda$) of the reflected light can be represented by the following formula, which is a function of pitch and average refractive index of CLC: $\lambda = n(avg) \cdot pitch$, where n(avg) is the average index of refraction. For example, when the average refractive index of CLC is 1.5 and the pitch is 430 nm, the wavelength of the reflected light is 645 nm and the reflective light becomes red. In this manner, the green color and the blue color also can be obtained by adjusting the pitch of the CLC.

In other words, the wavelength range of visible light is about 400 nm to 700 nm. The visible light region can be broadly divided into red, green, and blue regions. The wavelength of the red visible light region is about 660 nm, that of green is about 530 nm, and that of blue is about 470 nm. Due to the pitch of the cholesteric liquid crystal, the CLC color filter can selectively transmit or reflect the light having the intrinsic wavelength of the color corresponding to each pixel thereby clearly displaying the colors of red (R), green (G) and blue (B) with a high purity. In order to implement a precise color, a plurality of the CLC color filters can be arranged, to display the full color more clearly than a color filter of the related art. The cholesteric liquid crystal (CLC) color filter will be referred to as CCF herein after.

FIG. 1 is a schematic cross-sectional view illustrating a display area of a reflective liquid crystal display (LCD) device having a CCF (cholesteric liquid crystal color filter) layer according to a related art.

As shown, a reflective LCD device includes respective upper and lower substrates 10 and 30 and an interposed liquid crystal layer 50 therebetween. The upper and lower substrates 10 and 30 include transparent substrates 15 and 35, respectively, such as glass.

On a rear surface of the transparent substrate 15, the upper substrate 10 includes an upper transparent electrode 12. The upper substrate 10 also includes a retardation layer 20 and a polarizer 25 in series. The upper transparent electrode 12 applies an electric field to the liquid crystal layer 50 along with a lower transparent electrode 47. The retardation layer 20 is a quarter wave plate (QWP) that has a phase difference of $\lambda/4$ (lambda/4), and the polarizer 25 is a linearly polarizing plate that only transmits portions of light parallel with its polarizing axis.

The lower substrate 30 includes a light-absorbing layer 40 on a front surface of the transparent substrate 35. A CCF (cholesteric liquid crystal color filter) layer 45 including red (R), green (G) and blue (B) CLC color films in sub-pixels S1 are disposed on the light-absorbing layer 40. A lower transparent electrode 47 is disposed on the entire surface of the CCF layer 45. Three sub-pixels S1 of R, G and B CLC color films constitute one pixel P. The light-absorbing layer 40 selectively absorbs some portions of light incident from the R, G and B CCF color film. Although not shown in FIG. 1, driving circuits are disposed at the periphery of the LCD device in order to operate the reflective LCD device.

FIG. 2 is a plan view of a liquid crystal display device having driving circuits at the periphery according to the related art. A liquid crystal panel 100 may consist of an array substrate and a color filter substrate. Driving circuits including a control circuit 110, gate drivers 120 and data drivers 140 are formed at the periphery of the liquid crystal panel 100. A printed circuit board (PCB) 130, which is formed by a Surface Mounting Technology (SMT) in order to obtain a thin and integrated circuit, may be connected to the driving circuitry. The driving circuitry may be mounted using a tape carrier package (TCP) method.

FIG. 3 is a data voltage waveform applied to a CCF LCD device according to a related art. Additionally, FIG. 3 illustrates a voltage waveform that is appropriate for displaying desired images on the CCF LCD device. Widths of the steps of the waveform denote red (R), green (G) and blue (B) sub pixels, and the heights of the waveform denote a magnitude of the voltage. The magnitude of the voltage corresponds to a gray scale, and the voltages applied to one of red (R), green (G) and blue (B) sub pixels during one frame are the same.

FIG. 4 is a graph showing the timing of the data voltage applied to drive a CCF LCD according to a related art.

Within one pixel of the CCF LCD, one frame that is an interval between an applied data voltage to a next applied data voltage may be divided into two portions. The first portion t1 is a period where the cholesteric liquid crystal responses to the applied data voltage, and the second portion t2 is a period where the cholesteric liquid crystal maintains a desired reflectivity. Namely, the time that the real reflectivity and transmissivity is sensed by a human being can be represented by deducting the time of the first portion t1 (i.e., a liquid crystal response time) from one frame. If the same data voltage is applied to each of the R, G and B sub pixels during one frame, a certain color may have a relatively low reflectivity because the reflectivity depends on each sub pixel property. Moreover, if the certain color has a low reflectivity, the brightness of the LCD device may be degraded and an unequal white balance may result. The material for the cholesteric liquid crystal has a poor thermal resistance, so that its reflectivity becomes degraded when other fabrication processes are applied to the substrate having the cholesteric liquid crystal layer.

FIG. 5 is a graph illustrating spectra of light reflected by red (R), green (G) and blue (B) CLC color films. The CCF type reflective LCD device has peak wavelengths corresponding to the red (R), green (G) and blue (B) CLC color films. The respective peak points of the green (G) and blue (B) sub pixel are 0.22 and 0.24 in reflectivity. However, the red (R) sub pixel has a reflectivity of 0.15, which is significantly lower than the green (G) and blue (B) sub pixels. This is because the red (R) color filter has low thermal stability. Because the red (R) sub pixel has a reflectively lower that the green (G) and blue (B) sub pixels, the white balance of the CCF type reflective LCD device is not correct.

SUMMARY OF THE INVENTION

Accordingly, the present invention is directed to a CCF (cholesteric liquid crystal color filter) type reflective liquid crystal display device that substantially obviates one or more of the problems due to limitations and disadvantages of the related art.

An advantage of the present invention is to provide a CCF type reflective liquid crystal display device that has a high brightness and an improved color display.

Another advantage of the present invention is to provide a CCF type reflective liquid crystal display device having an improved reflectivity and an improved white balance.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device comprises: a liquid crystal display panel; a cholesteric liquid crystal layer in the liquid crystal panel; a data controller having a connection with the liquid crystal display panel, wherein the data controller receives red, green and blue data signals from an external source and provides the signals to the liquid crystal panel; and a data amplifying circuit in the data controller, the data amplifying circuit selecting one of the red, green and blue data signals and then overdriving the selected data signal.

In another aspect of the present invention, a method for improving the brightness and color display of a reflective liquid crystal display device having a cholesteric liquid crystal color layer comprises: determining a subpixel color having a weaker reflectivity than another subpixel color; and overdriving a voltage to the subpixel color having the weaker reflectivity.

In another aspect of the present invention, a method for improving the brightness and color display of a liquid crystal display device having a cholesteric liquid crystal color layer comprises: providing a subpixel data signal having a first voltage level; and providing a subpixel data signal having a second voltage level.

The liquid crystal display device further includes a timing controller for generating an H-synchronization signal and transferring the H-synchronization signal to the liquid crystal panel. The data amplifying circuit selects the red data signal and overdrives the red data signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiment of the present invention, example of which is illustrated in the accompanying drawings. Wherever possible, the same reference numbers will be used throughout the drawings to refer to the same or like parts.

Figure 6:
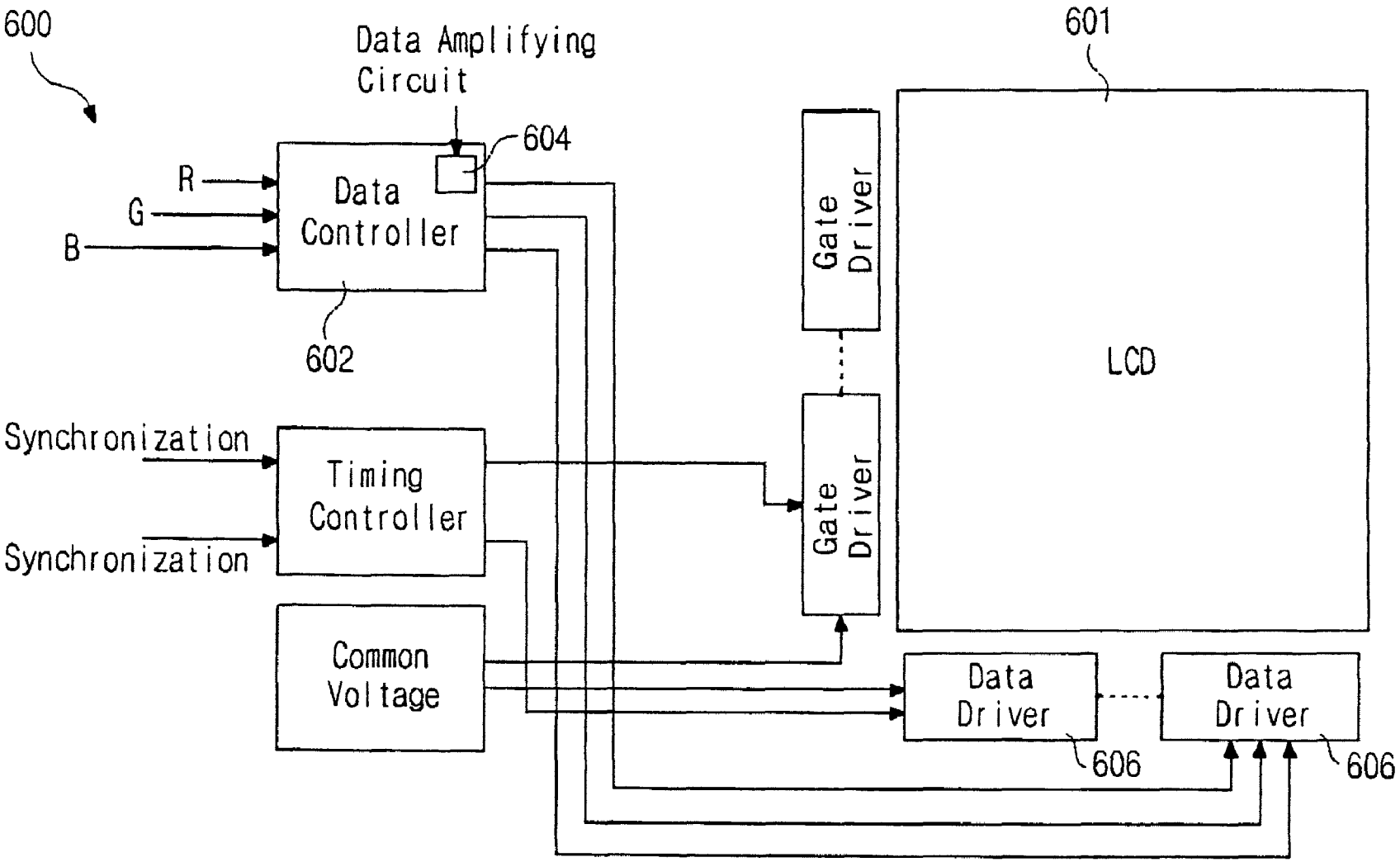
FIG. 6 is a block diagram illustrating driving circuits for an LCD device according to the present invention.

FIG. 6 is a block diagram illustrating driving circuits for an LCD device 601 according to an embodiment of the present invention 600. Red (R), green (G) and blue (B) signals are applied to a data controller 602 from a video RAM. The data controller 602 includes a data amplifying circuit 604. The red (R) signals for the red sub pixels pass through the data amplifying circuit 604 and then are overdriven by the data amplifying circuit 604. The green (G) and blue (B) signals for the green and blue sub pixels do not pass through the data amplifying circuit 604. Each data driver 606 is connected to a shift register (not shown) in series, and the data drivers 606 are latched by an H-synchronization signal of a timing controller 608. Thus, signal voltages are applied to signal lines of the LCD by way of using D/A (digital/analog) converters or switching elements.

Figure 7:
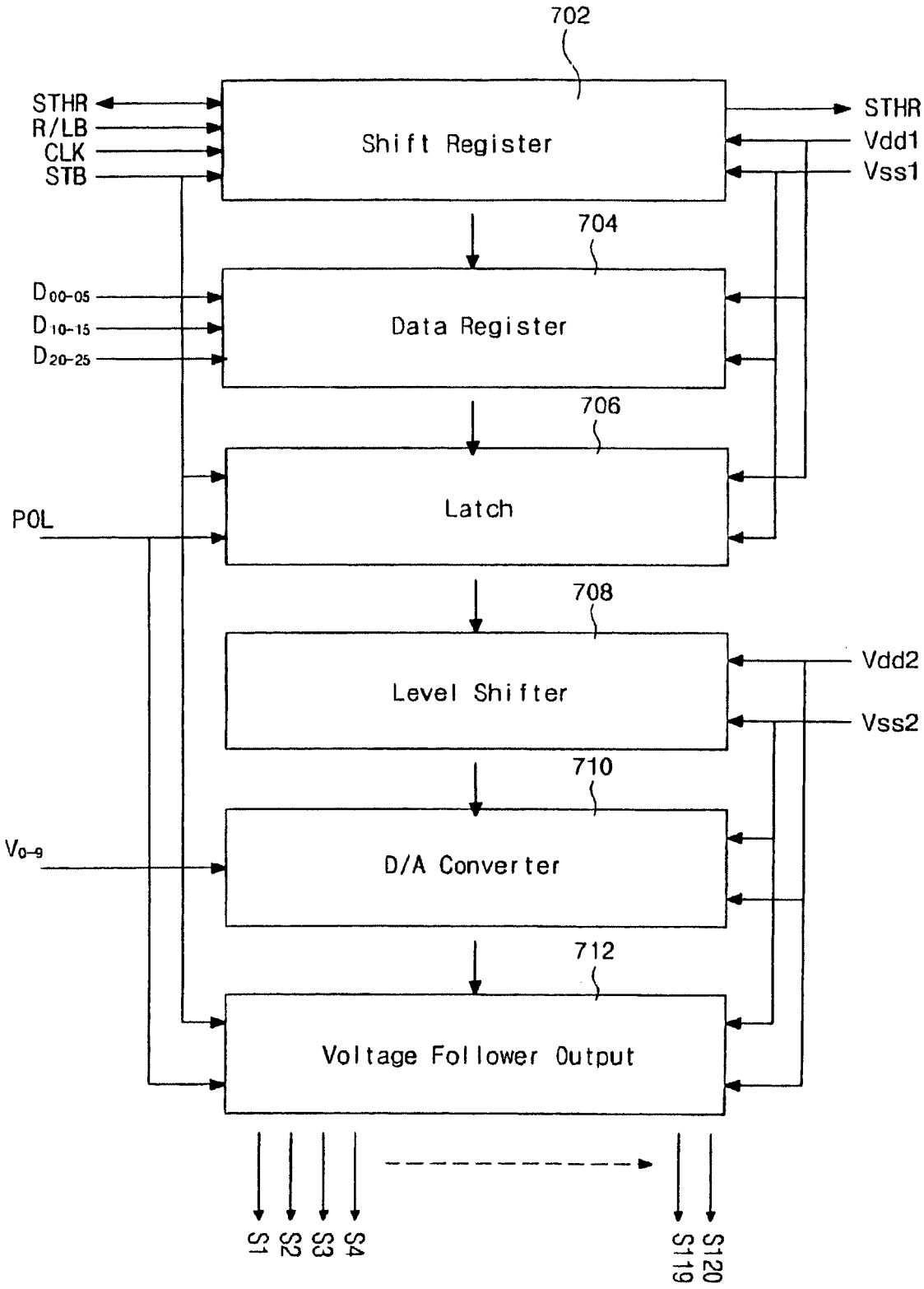
FIG. 7 is an internal block diagram of a data driver according to the present invention.

FIG. 7 is an internal block diagram of a data driver 606 according to the present invention. Input signals include a 6-bit RGB data signal, V0-V9 gray scale voltages, and timing signals. A shift register 702 receives clock and carry signals so as to start operating, and then the input digital data are stored in each data register 704 in accordance with the pulses of the clock and carry signals. Then the clock and carry signals are transferred to a latch 705 after one row line data are stored by repeating the storing process. The image data in the latch may all be 5V level logic. And because a liquid crystal driving voltage is higher than the 5V level, the input signals are upgraded to a higher driving voltage level through a level shifter 708, and a D/A converter 710 selects a desired voltage among the gray scale voltages inputted in accordance with the image signals. Thereafter, a voltage follower output 712 transfers the input signals to the liquid crystal panel 601 after current amplifying. However, in the present invention, the data signal for the red sub pixels is overdriven in order to shorten the liquid crystal response time, and thus the data signal is divided or converted into two voltage signals.

Figure 1:
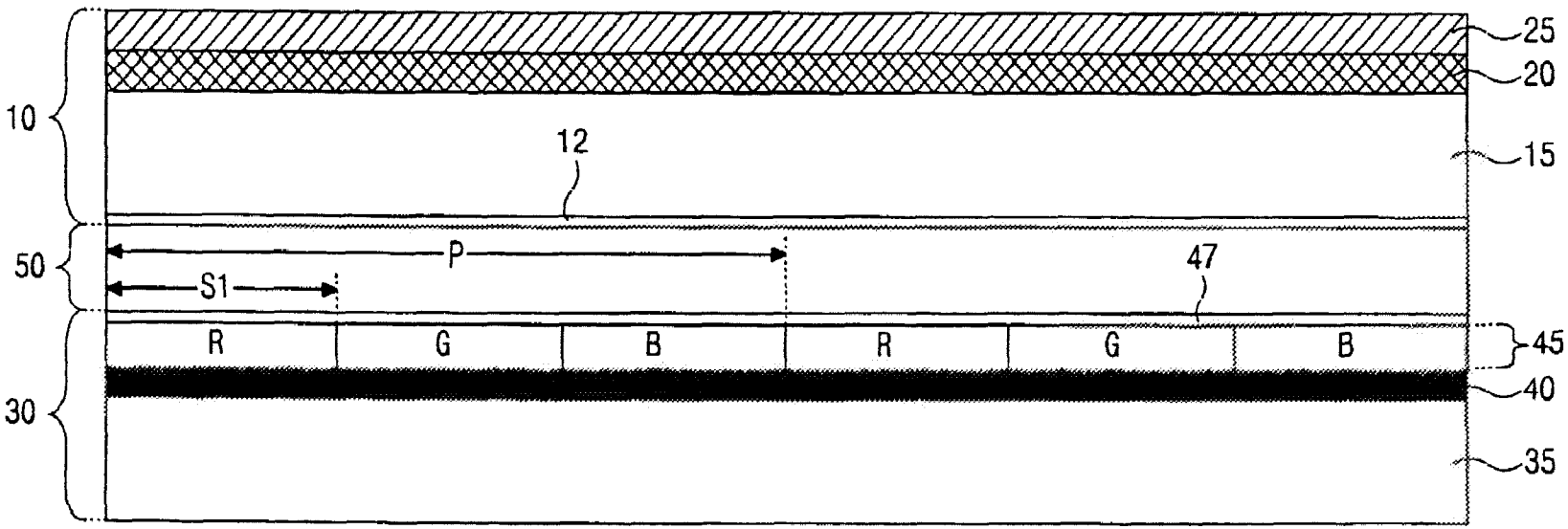
FIG. 1 (Related Art)
FIG. 1 is a schematic cross-sectional view illustrating a display area of a reflective liquid crystal display (LCD) device having a CCF (cholesteric liquid crystal color filter) layer according to the related art.
Figure 2:
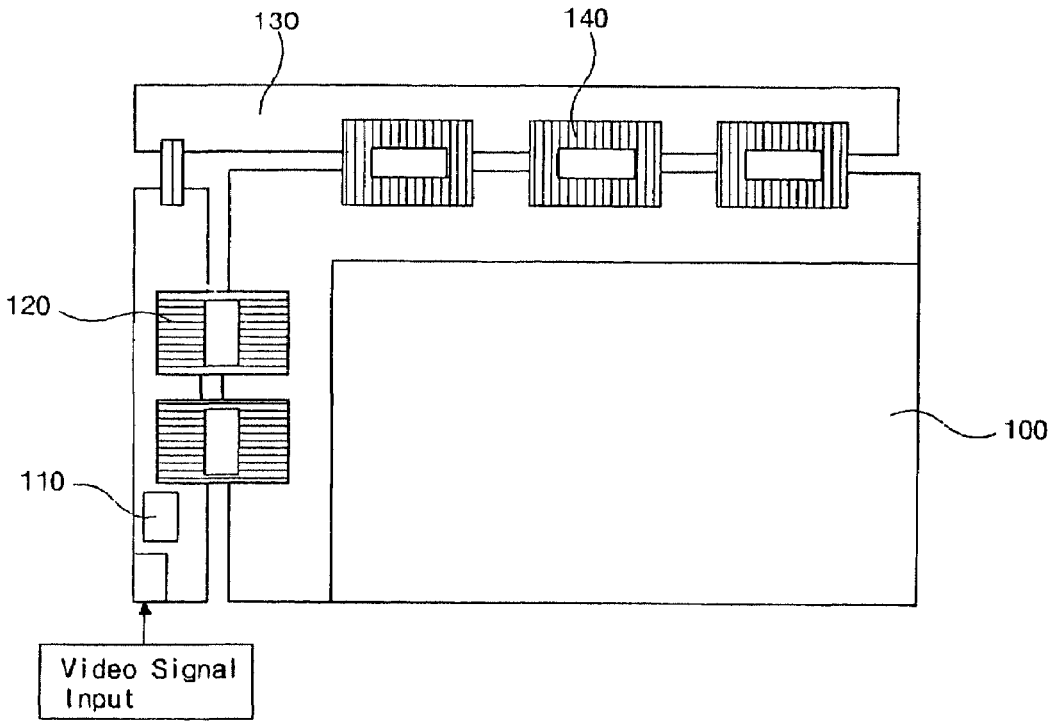
FIG. 2 (Related Art)
FIG. 2 is a plan view of a liquid crystal display device having driving circuits at the periphery according to the related art.
Figure 3:
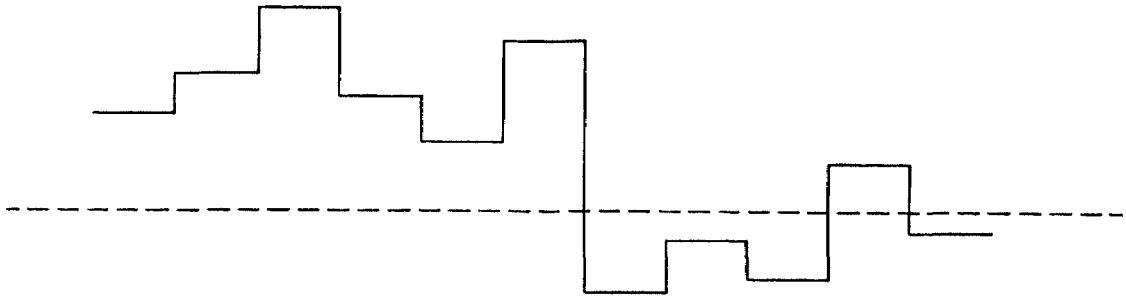
FIG. 3 (Related Art)
FIG. 3 is a data voltage waveform applied to a CCF LCD device according to the related art.
Figure 4:
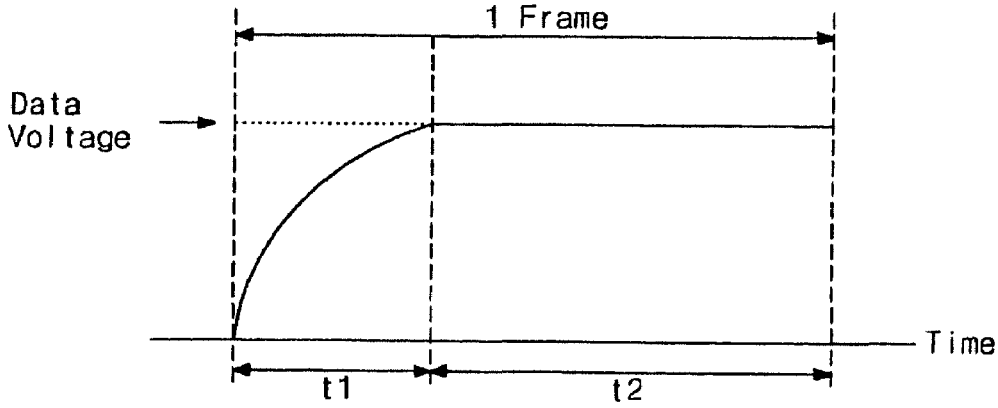
FIG. 4 (Related Art)
FIG. 4 is a graph showing a timing chart of data voltage applied for driving a CCF LCD according to the related art.
Figure 5:
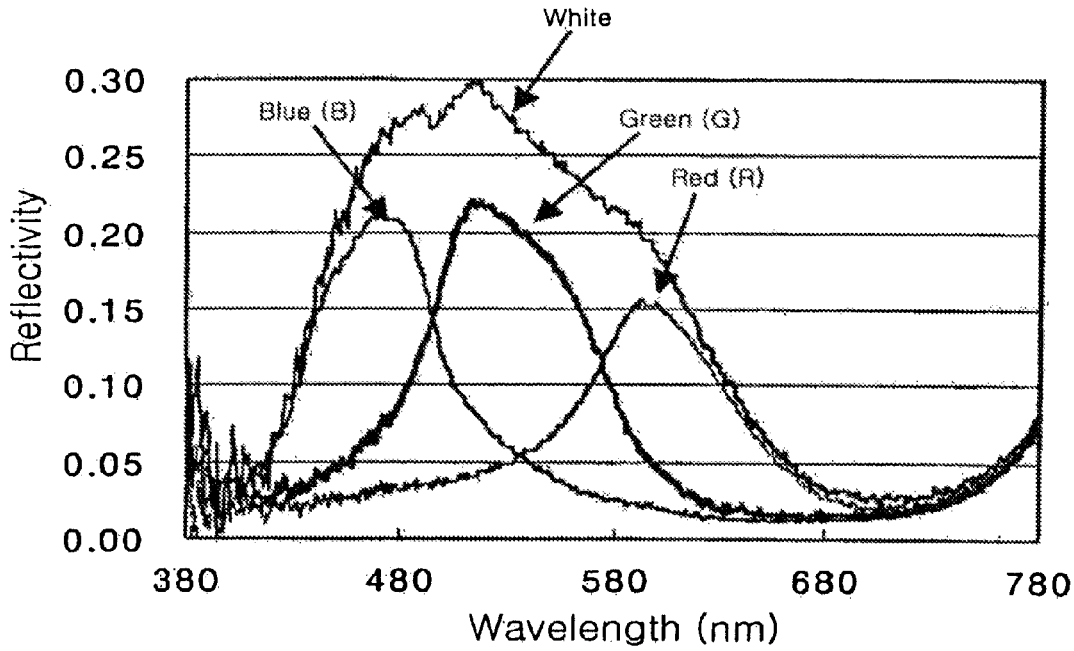
FIG. 5 (Related Art)
FIG. 5 is a graph illustrating spectra of light reflected by red (R), green (G) and blue (B) CLC color films.
Figure 8:
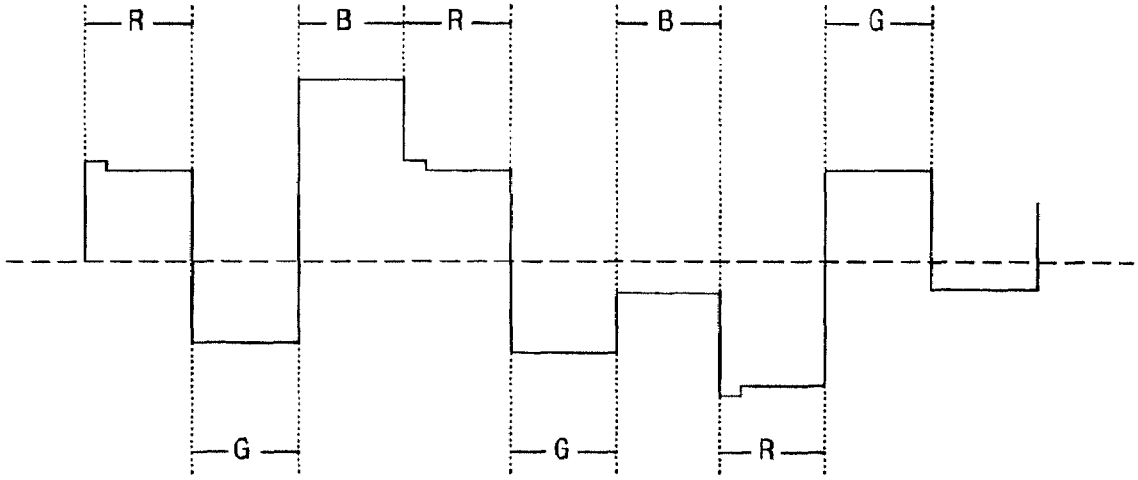
FIG. 8 is a data voltage waveform applied to the LCD device according to the present invention.

FIG. 8 is a hypothetical data voltage waveform applied to the LCD device according to the present invention. The voltages for driving the green (G) and blue (B) sub pixels are substantially the same as the conventional one shown in FIG. 3. Namely, the voltages for the green (G) and blue (B) sub pixels are regular during one frame. However, the voltages for the red (R) sub pixels substantially have a step profile. Namely, during one frame, the voltage for the red (R) sub pixel includes a first step voltage with a certain level and a second step voltage being essentially the same as the voltage for driving the green (G) and blue (B) sub pixels.

Figure 9:
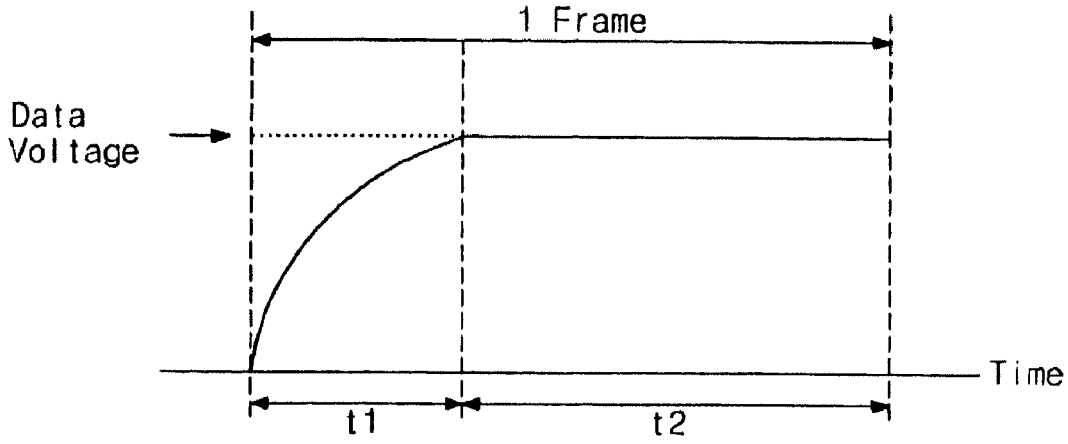
FIG. 9 is a graph showing a timing chart of data voltage applied for driving green and blue sub pixels of the LCD according to the present invention.
Figure 10:
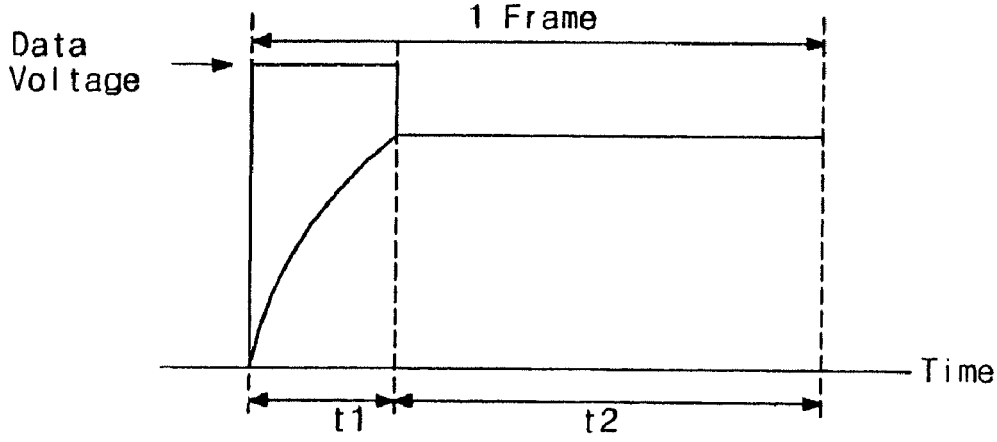
FIG. 10 is a graph showing a timing chart of data voltage applied for driving red sub pixels of the LCD according to the present invention.

FIG. 9 is a graph showing the timing of the data voltage applied to drive the green and blue sub pixels of the LCD according to the present invention. FIG. 10 is a graph showing the timing of the data voltage applied to drive the red sub pixels of the LCD according to the present invention.

In FIG. 9, the data voltage for the green and blue sub pixels has a one-step profile like a conventional driving voltage. But the data voltage for the red sub pixels essentially has a two-step profile as shown in FIG. 10. As compared to the voltage for the red sub pixels, the voltage for the green and blue sub pixels has a longer response time t1. The cholesteric liquid crystal provides a desired reflectivity in accordance with the input data voltages.

In FIG. 10, in order to reduce a liquid crystal response time, a voltage a little bit higher than the data voltage is input during the first portion t1 of one frame. In other words, the data voltage for the red sub pixels is overdriven in order to shorten the response time t1, and to increase the second portion t2 where the cholesteric liquid crystal maintains its own reflectivity.

Accordingly in the present invention, because the data amplifying circuits in the data controller are only overdriving the data voltages for the red sub pixels, the response speed in the red sub pixels increases and the reflectivity of red sub pixels is improved. Furthermore, the overdriving technique can also be adopted in the green and blue sub pixels. Therefore, the reflective liquid crystal display device can have improved white balance, brightness and color display ability.

It will be apparent to those skilled in the art that various modifications and variations may be made in the present invention without departing from the spirit or scope of the invention. Thus, it is intended that the present invention cover the modifications and variations of this invention provided they come within the scope of the appended claims and their equivalents.

What is claimed is:

1. A method for improving the brightness and color display of a liquid crystal display device having a cholesteric liquid crystal color layer comprising:

receiving a data signal from an external source;

providing a subpixel data signal having a first voltage level to a subpixel according to the data signal; and providing a subpixel data signal having a second voltage level to the subpixel according to the data signal, wherein the first voltage level has a greater magnitude than the second voltage level, wherein the subpixel data signal having the first voltage level and the subpixel data signal having the second voltage level are sequentially provided during a frame to thereby display a subpixel color.

2. The method of claim 1, wherein a duration of the first voltage level is substantially equal to a liquid crystal response time corresponding to the subpixel color.

3. The method of claim 2, wherein a first voltage level duration is different for each subpixel color.

4. The method of claim 2, wherein a first voltage level duration for each subpixel color substantially equalizes a reflectivity for each subpixel color.

5. The method of claim 1, wherein a relative magnitude between the first voltage level and the second voltage level are different for each subpixel color.

6. The method of claim 5, wherein the difference in the relative magnitude substantially equalizes a reflectivity of each subpixel color.

* * * * *